US005606745A

United States Patent [19]

Gray

[11] Patent Number: 5,606,745

[45] Date of Patent: Mar. 4, 1997

[54] RESISTANCE EXERCISE SUIT WITH SEMI-RIGID RESISTANT RIBS

[76] Inventor: James C. Gray, 2405 Alcoa Hwy., Knoxville, Tenn. 37920

[21] Appl. No.: 589,803

[22] Filed: Jan. 22, 1996

[51] Int. Cl.[6] ..... A41D 1/08

[52] U.S. Cl. ..... 2/69; 2/227; 2/228; 2/79; 482/121

[58] Field of Search ..... 2/69, 70, 79, 80, 2/227, 228; 482/121, 122, 124, 125, 105

[56] References Cited

U.S. PATENT DOCUMENTS 4,065,814 1/1978 Fox .
4,910,802 3/1990 Malloy .
5,109,546 5/1992 Dicker .
5,176,600 1/1993 Wilkinson .
5,201,074 4/1993 Dicker .
5,306,222 4/1994 Wilkinson .
5,357,637 10/1994 Moore .

*Primary Examiner*—C. D. Crowder
*Assistant Examiner*—Gloria Hale

[57] ABSTRACT

A resistance exercise suit for providing a resistance to movement to exercise the wearer's muscles. The resistance exercise suit includes a body suit to which at least one resilient rib is secured for biasing a selected body portion in a preselected position such that when the wearer moves the body portion, he experiences resistance. The resilient rib is tailorable to a particular individual's needs, and specifically, the shape, length, thickness and resistance are alterable properties.

14 Claims, 1 Drawing Sheet

RESISTANCE EXERCISE SUIT WITH SEMI-RIGID RESISTANT RIBS

TECHNICAL FIELD

This invention relates to the field of exercise suits and more specifically to an exercise suit which utilizes preformed resilient ribs to provide resistance to body portions or body sections of the wearer.

BACKGROUND ART

Many types of exercise suits have been developed with which resistant members are utilized to provide resistance against the movement of the wearer. The extra resistance provides a more intense workout.

Another use of an exercise suit with resistant members is in a zero gravity environment such as that in space. The zero gravity environment of space can contribute to the loss of muscle tone because of the lack of resistance created by gravitational forces. With the time astronauts spend in space extending to longer periods, the loss of muscle tone becomes a bigger concern. One solution is for the astronauts to wear a resistant exercise suit which provides a resistance corresponding to the gravitational weight of various body segments.

Typical of the art of exercise suits which utilize resistant members are those suits disclosed in the following U.S. Patents:

| Pat. No. | Inventor(s) | Issue Date |
|---|---|---|
| 4,065,814 | E. N. Fox | January 3, 1978 |
| 4,910,802 | E. A. Malloy | March 27, 1990 |
| 5,109,546 | T. P. Dicker | May 5, 1992 |
| 5,176,600 | W. T. Wilkinson | January 5, 1993 |
| 5,201,074 | T. P. Dicker | April 13, 1993 |
| 5,306,222 | W. T. Wilkinson | April 26, 1994 |
| 5,357,637 | D. F. Moore | October 25, 1994 |

The '814, '802, '546, and the '074 patents include the use of elastic bands secured directly to the exercise clothing to provide resistance during exercise. The elastic bands are anchored around the body, wrists and feet. With the elastic bands anchored around the body in such a manner, the clothing to which the elastic bands are secured can become uncomfortable to wear as one exercises. The clothing can pull down or pull up and the wearer must continually pull and tug at the clothing to adjust it.

The '600, '222, and '637 patents teach exercise garments where elastic bands are utilized to connect one body portion to another. For example, in the '600 patent elastic webs are utilized wherein one end is secured to the side of the body of the garment and the other end is secured to underside of the arm. Also, an elastic web is secured to the inner thighs of the garment. In the '222 patent, one end of an elastic band is anchored to an ankle and the other end is anchored to the wrist with the elastic band extending therebetween. The bands or webs are carried exterior from the exercise garment. If a person is trying to move around the devices can easily become entangled or snag on surrounding objects.

Therefore, it is an object of the present invention to provide a resistance exercise suit into which resilient ribs are incorporated.

It is another object of the present invention to provide a resistance exercise suit wherein the resilient ribs are preformed such that the exercise suit is comfortable to wear.

Further, it is an object of the present invention to provide a resistance exercise suit wherein the resistance and configuration of the resilient ribs can be customized to any individual.

SUMMARY

Other objects and advantages will be accomplished by the present invention which teaches a resistance exercise suit for providing resistance to movement to exercise the user's muscles. The resistance exercise suit includes a body suit to which at least one resilient rib is secured for biasing a selected body portion in a preselected position such that when the wearer moves the body portion he experiences resistance. The resilient rib is tailorable to a particular individual's needs, and specifically, the length, thickness and resistance are alterable properties.

BRIEF DESCRIPTION OF THE DRAWINGS

The above mentioned features of the invention will become more clearly understood from the following detailed description of the invention read together with the drawings in which.

DESCRIPTION OF PREFERRED EMBODIMENTS

A resistance exercise suit incorporating various features of the present invention is illustrated generally at 10 in the figures. The resistance exercise suit 10 is designed to include preformed resilient ribs such that the exercise suit is comfortable to wear. Further, the properties of the resilient ribs are tailorable to any individual.

Figure 1:
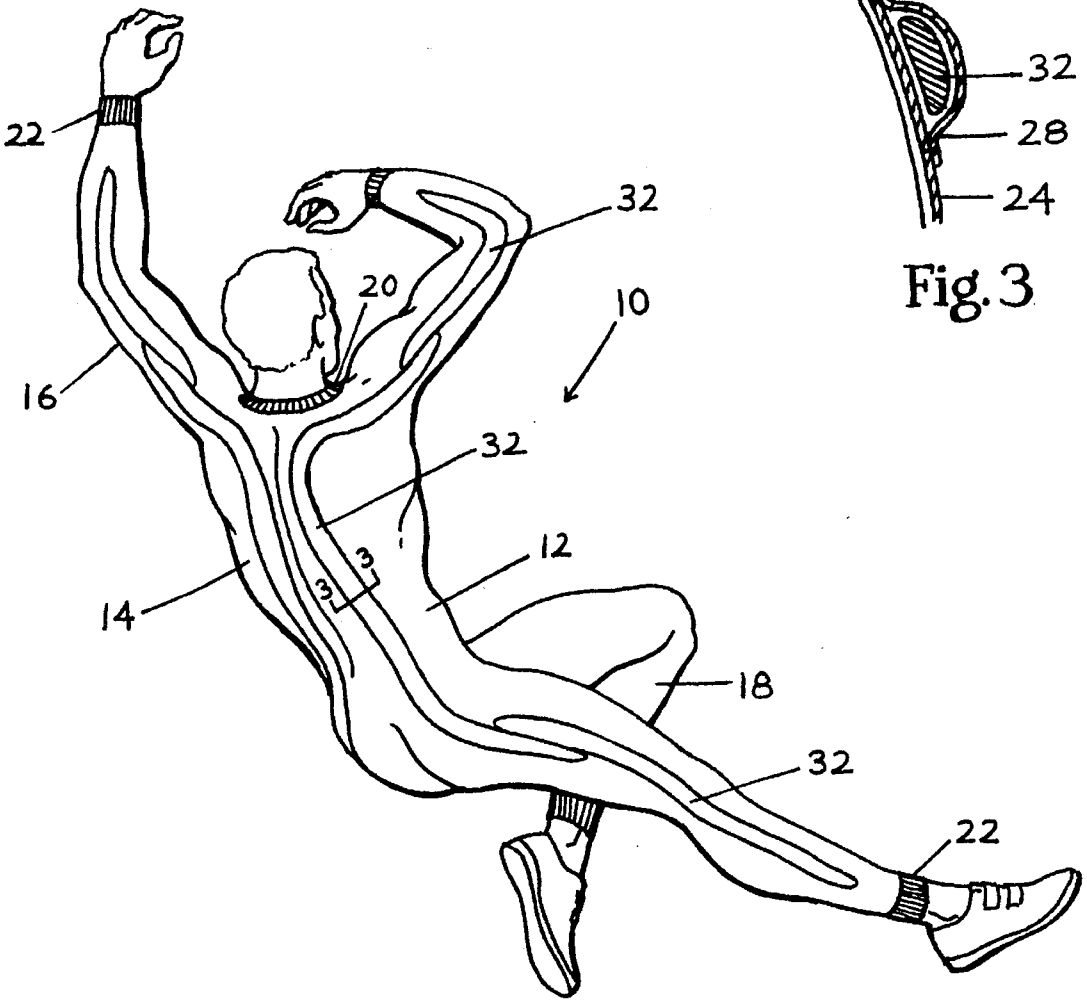
FIG. 1 is a perspective view of the resistance exercise suit constructed in accordance with several features of the present invention.

The resistance exercise suit 10 is generally comprised of a form fitting body suit 12 to which at least one resilient rib 32 is secured. The resilient rib 32 is configured to bias a body portion in a preselected position. In the preferred embodiment, the resilient ribs 32 are carried within elongated pockets 28 which are secured to the outer surface 24 of the body suit 12, as shown in FIG. 1.

In the preferred embodiment, the body suit 12 is a one piece suit with a closure in the front which permits the wearer to put the body suit 12 on and remove it. The closure is preferably a zipper. The body suit 12 defines a trunk portion 14, two sleeves 16, which are configured to extend to the wrists of the wearer, and two legs 18, which are configured to extend to the ankles of the wearer, as shown in FIG. 1. In the preferred embodiment, the neck 20 and the ends of each of the sleeves 16 and legs 18 of the body suit 12 carry a ribbed knitting 22 for securely and comfortably gripping the neck, wrists and ankles of the wearer. Preferably, the body suit 12 is fabricated from a material which wicks away moisture from the skin.

The elongated pockets 28 are secured to the outer surface 24 of the body suit 12 and define at least one opening for receiving an resilient rib 32. In the preferred embodiment, elongated pockets 28 are secured along the sleeves 16, the trunk portion 14 and along the legs 18 of the body suit 12. Preferably, the elongated pockets 28 are sewn to the body suit 12. The pockets 28 must be durably secured to the body suit 12 such that, with repeated movement of the body, the pockets 28 do not tear from the body suit 12.

Preferably, the resilient ribs 32 are fabricated from a semi-rigid elastomeric material such as silicone rubber. The amount of resistance to movement imparted by the rib 32 can be preselectively controlled by varying the thickness of the rib 32. It will be understood by those skilled in the art that the force necessary to deform the elastomeric material of the rib 32, such material typically being of substantially uniform density, increases with the thickness of such material. Therefore, the rib 32 can be molded with one or more portions or areas having increased thicknesses to produce a greater resistance to movement of the wearer's body proximate that area. For example, it may be desirable to have more resistance at the shoulder and less at the elbow. Moreover, the rib 32 can be molded to create directional resistance. For example, a rib 32 with a circular cross section will provide an equal level of resistance in any direction. A rib 32 with an oval cross section will provide the most resistance along the thickest line of the rib 32 and the least resistance along the thinnest line of the rib 32.

It may be desirable to reduce or increase the elasticity of the rib 32 without substantially reducing or increasing its thickness. For example, to reduce the elasticity of the rib 32, elastomeric stiffeners may be molded into the rib to provide a less elastic rib.

Of course, other materials can be used which increase or decrease the elasticity. It is conceivable to utilize a material in which the modulus of elasticity can be varied by treatment of sections of the material. For instance, some materials, such as a variety of polymers, when irradiated, undergo a change in the modulus of elasticity. The thickness and extent of the regions of differing moduli of elasticity can be controlled such that a desired resistance is attained. Further, it will be noted that different materials with varying moduli of elasticity can be molded together to produce the desired resistance.

Because the resilient ribs 32 are molded, the form of the ribs 32 is tailorable to the particular attributes of any individual. For example, the shape and the length of each rib 32 are tailorable properties. Moreover, the ribs 32 are formed to bias the body portions in a preselected position such that the body portions meet with resistance when moved from this preselected position.

In the embodiment shown in FIG. 1, the ribs 32 are sectioned for ease of insertion into the elongated pockets 28. More specifically, an individual rib 32 is fabricated for portions of the body and particularly for each arm, each leg and along the shoulder to the upper thigh of the wearer, as shown in FIG. 1. With this configuration, the second end of one rib 32 must overlap the first end of the adjoining rib 32, as shown in FIG. 1. The ribs 32 must overlap to maintain a continuous resistance.

Figure 2:
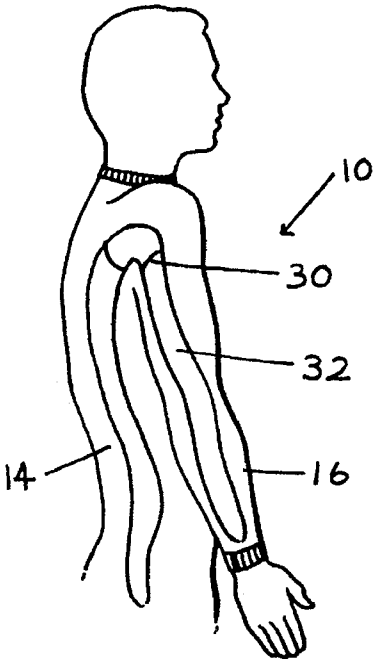
FIG. 2 is a partial view of the resistance exercise suit proximate the arm and the side of the body; and, FIG. 3 illustrates a cross sectional view of the resilient rib taken at 3—3 of FIG. 1.
Figure 3:
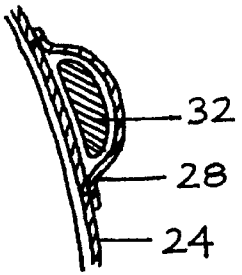

In another embodiment, a portion of which is shown in FIG. 2, the ribs 32 are unitary such that one rib 32 is molded to provide resistance to a portion of the body including the arm, along the back and the leg. Similarly, a rib 32 is molded to provide resistance to the other side of the body. In this embodiment, the elongated pocket 28 defines an opening 30 proximate the shoulder, as shown in FIG. 2, such that the insertion of the rib 32 into the pocket 28 is eased.

It will be noted that the needs of the wearer dictate the configuration of the ribs 32. For example, an individual may want the suit 10 for exercising the top portion of his body. In this embodiment, ribs 32 can be formed for the arms and the trunk portion of his body and ribs for the legs are not necessary. With this particular configuration, the legs of body suit need only extend to the upper thigh.

The exercise suit 10 as shown in FIG. 1 can be used to maintain muscle tone of the wearer in a zero gravity environment. Specifically, the ribs 32 are formed to provide a resistance which corresponds to the gravitational weight of the body portions on earth. In the preferred embodiment, the ribs 32 are configured to bias the body portions in a relaxed position.

Another use of the resistance exercise suit 10 is during a normal workout. The ribs 32 can be formed to provide resistance in any selected direction. For example, the ribs 32 can be formed to bias the arms in a relaxed position such that the wearer experiences resistance when raising his arms. Likewise, the ribs 32 can be formed to bias the arms in a raised position such that the wearer experiences resistance when he lowers his arms to his side. These examples can be translated to ribs formed for the back and legs. Moveover, resilient ribs can be secured to the front of the suit to provide resistance during an abdominal muscle workout.

From the foregoing description, it will be recognized by those skilled in the art that an exercise suit offering advantages over the prior art has been provided. Specifically, the exercise suit includes preformed resilient ribs carried thereon such that the exercise suit is comfortable to wear. Moreover, the resistance and configuration of the resilient ribs can be customized to any individual.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A resistance exercise suit comprising:

a body suit defining a trunk portion from which two sleeves and two legs extend for receiving the body of a wearer, at least one resilient rib being secured to said body suit, said resilient rib being semi-rigid and defining a degree of resistance, said resilient rib being configured to bias a body portion of the wearer in a preselected position.

2. The resistance exercise suit of claim 1 further including at least one elongated pocket secured to an outer surface of said body suit, said at least one elongated pocket being configured to receive said at least one resilient rib.

3. The resistance exercise suit of claim 1 wherein said at least one resilient rib is fabricated from an elastomeric material.

4. The resistance exercise suit of claim 1 wherein a shape, a length, a thickness and said degree of resistance of said at least one resilient rib is tailorable to a body portion.

5. The resistance exercise suit of claim 1 wherein said at least one resilient rib defines a preselected thickness to achieve said degree of resistance.

6. The resistance exercise suit of claim 1 wherein said degree of resistance is substantially equal to the gravitational weight of the body portion such that, in a zero gravity environment, the body portion experiences a resistance substantially equal to its gravitational weight when the body portion is moved.

7. The resistance exercise suit of claim 1 includes two resilient ribs each being configured to support a side of the body, each of said two resilient ribs extending along an arm, a shoulder, a side of the back and a leg of the wearer.

8. A resistance exercise suit comprising:

a body suit defining a trunk portion from which two sleeves and two legs extend for receiving the body of a wearer, a plurality of resilient ribs being secured to said body suit, each of said plurality of resilient ribs being semi-rigid and defining a degree of resistance, each of said plurality of resilient ribs being configured to bias a body portion of the wearer in a preselected position; and, a plurality of elongated pockets secured to an outer surface of said body suit, each of said plurality of elongated pockets being configured to receive one of said plurality of resilient ribs.

9. The resistance exercise suit of claim 8 wherein each of said plurality of resilient ribs is fabricated from an elastomeric material.

10. The resistance exercise suit of claim 8 wherein a shape, a length, a thickness and said degree of resistance of each of said plurality of resilient ribs is tailorable to a body portion.

11. The resistance exercise suit of claim 8 wherein each of said plurality of resilient ribs defines a preselected thickness to achieve said degree of resistance.

12. The resistance exercise suit of claim 11 wherein said preselected thickness varies along a length of each of said plurality of resilient ribs.

13. The resistance exercise suit of claim 8 wherein said degree of resistance of each of said plurality of resilient ribs is substantially equal to the gravitational weight of the body portion to which each of said resilient ribs conforms such that, in a zero gravity environment, the body portion experiences a resistance substantially equal to its gravitational weight when the body portion is moved.

14. A resistance exercise suit comprising:

a body suit defining a trunk portion from which two sleeves and two legs extend for receiving the body of a wearer, at least one resilient rib being secured to said body suit, said resilient rib defining a degree of resistance and a preselected thickness to achieve said degree of resistance, said preselected thickness varying along a length of said at least one rib, said resilient rib being configured to bias a body portion of the wearer in a preselected position.

* * * * *